United States Patent [19]

Lombardino et al.

[11] 3,980,869

[45] Sept. 14, 1976

[54] ROTATABLE KEYBOARD

[75] Inventors: Paul A. Lombardino, Berkeley Heights; Jean H. Wickstead, Wayne; Edward E. Schroeder, New Providence, all of N.J.

[73] Assignee: Litton Business Systems, Inc., Morris Plains, N.J.

[22] Filed: Nov. 25, 1974

[21] Appl. No.: 526,527

[52] U.S. Cl. ..... 235/146

[51] Int. Cl.[2] ..... G06C 7/02

[58] Field of Search ..... 235/145–146, 235/12, 55, 59, 61 PG, 61 PJ, 61 PK, 82 R; 200/5 R; 340/147, 365; 197/78, 98; 178/79, 81; 179/90 R, 91 R, 178, 179

[56] References Cited

UNITED STATES PATENTS

| | | | |
|---|---|---|---|
| 1,301,212 | 4/1919 | Albright | 200/5 R |
| 1,815,997 | 7/1931 | Williams | 235/145 R |
| 3,561,675 | 2/1971 | Wolf | 235/146 |

*Primary Examiner*—L. T. Hix
*Assistant Examiner*—Vit W. Miska
*Attorney, Agent, or Firm*—Stephen A. Roen; Norman Friedman; Robert F. Rotella

[57] ABSTRACT

A data processing console having a rotatable keyboard.

8 Claims, 4 Drawing Figures

ROTATABLE KEYBOARD

BACKGROUND OF THE INVENTION

Auxiliary numeric and control input keyboards used in data processing equipment have been developed but these have various shortcomings which affect their usefulness. These auxiliary keyboards have employed a non-rotatable keyboard in combination with a fixed main input keyboard of the alpha-numeric typewriter arrangement on the same shelf of the data processing equipment's console. Such auxiliary keyboard can not be rotated for a seated operator's ease of usage, efficiency and accuracy as well as to decrease operator's fatigue.

SUMMARY OF THE INVENTION

It is therefore an object of this invention to provide a rotatable auxiliary keyboard for data processing apparatus.

A further object of this invention is to provide a data processing console having an easily rotatable auxiliary keyboard.

An additional object of this invention is to provide a rotatable auxiliary keyboard for a data processing unit which is simple and inexpensive to manufacture.

These and other objects of the present invention are accomplished in the illustrative embodiment by providing a rotatable auxiliary numeric and control keyboard unit having a circular thin keyboard mask panel to which the keyboard unit fits through and attaches to. The keyboard mask panel is rotatably supported at its edges by a plurality of supporting assemblies.

DETAILED DESCRIPTION OF THE INVENTION

Figure 1:
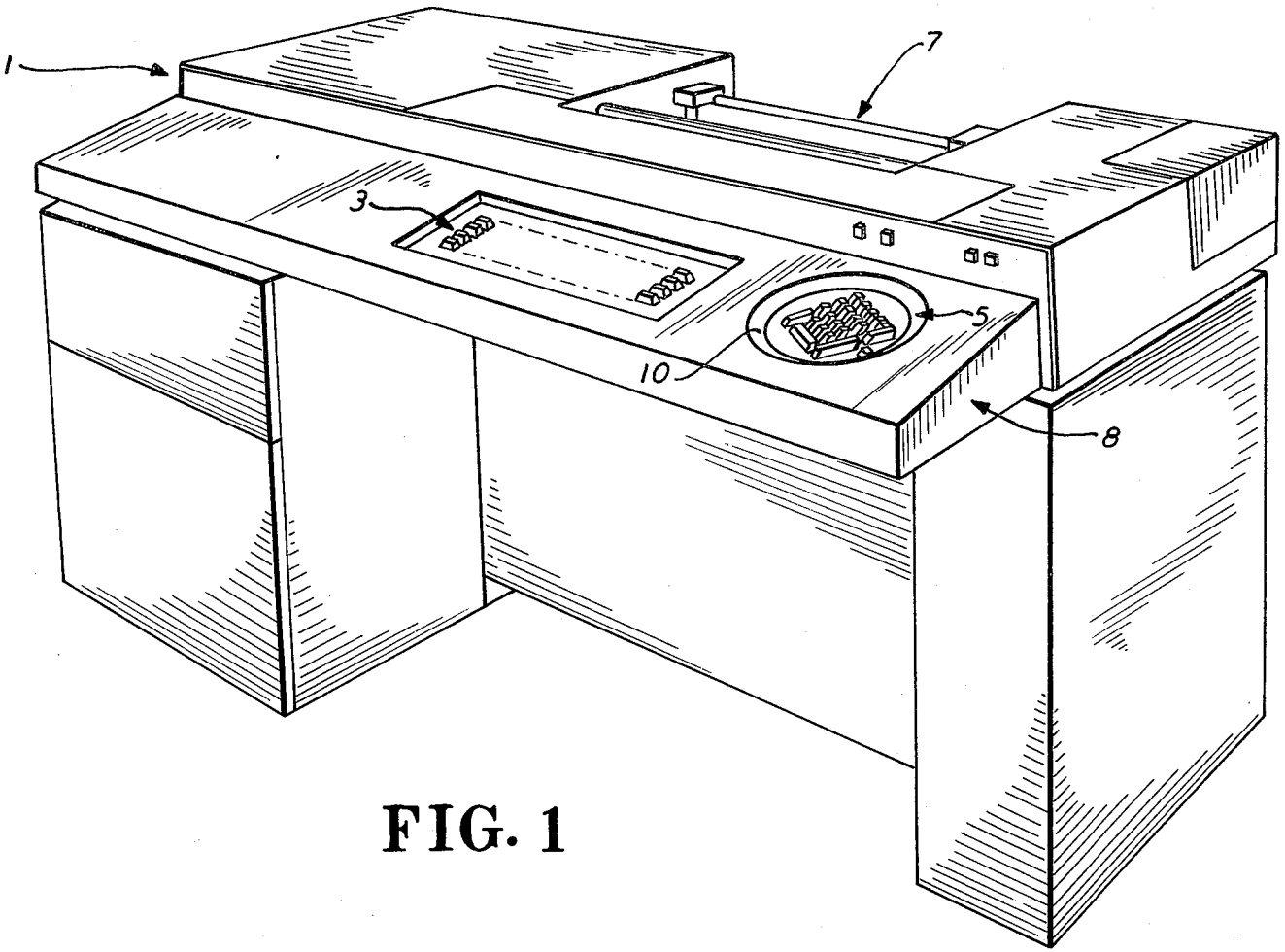
FIG. 1 is a perspective view of the data processing console unit embodying the present invention.

Referring to the drawings and particularly to FIG. 1, a data processing console unit 1 having a fixed main input keyboard 3 of the standard alpha-numeric typewriter arrangement, a rotatable auxiliary and control input keyboard 5, and an output printing mechanism 7 is illustrated. Numeric figures can be entered from either keyboard inter-changeably in a conventional manner by an operator. Both keyboards 3 and 5 are located on common shelf 8 of the console and to facilitate optimum usage of both keyboards the auxiliary keyboard 5 is separated from the main keyboard 3 and rotatably mounted for operator ease, efficiency, accuracy and decreased fatigue.

Figure 2:
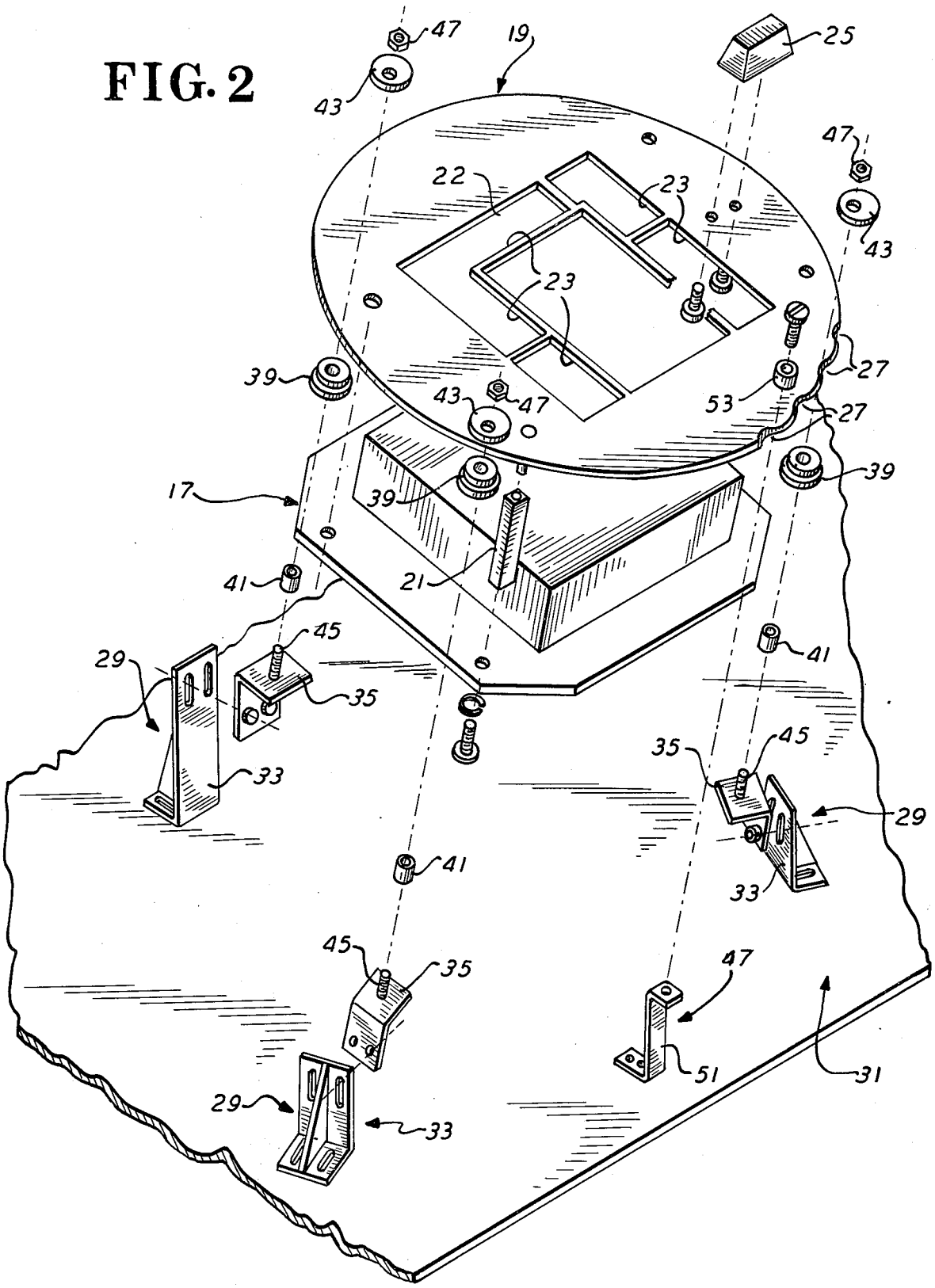
FIG. 2 is an exploded, detailed perspective view of portions of the rotatable keyboard utilized in the console unit of FIG. 1.
Figure 3:
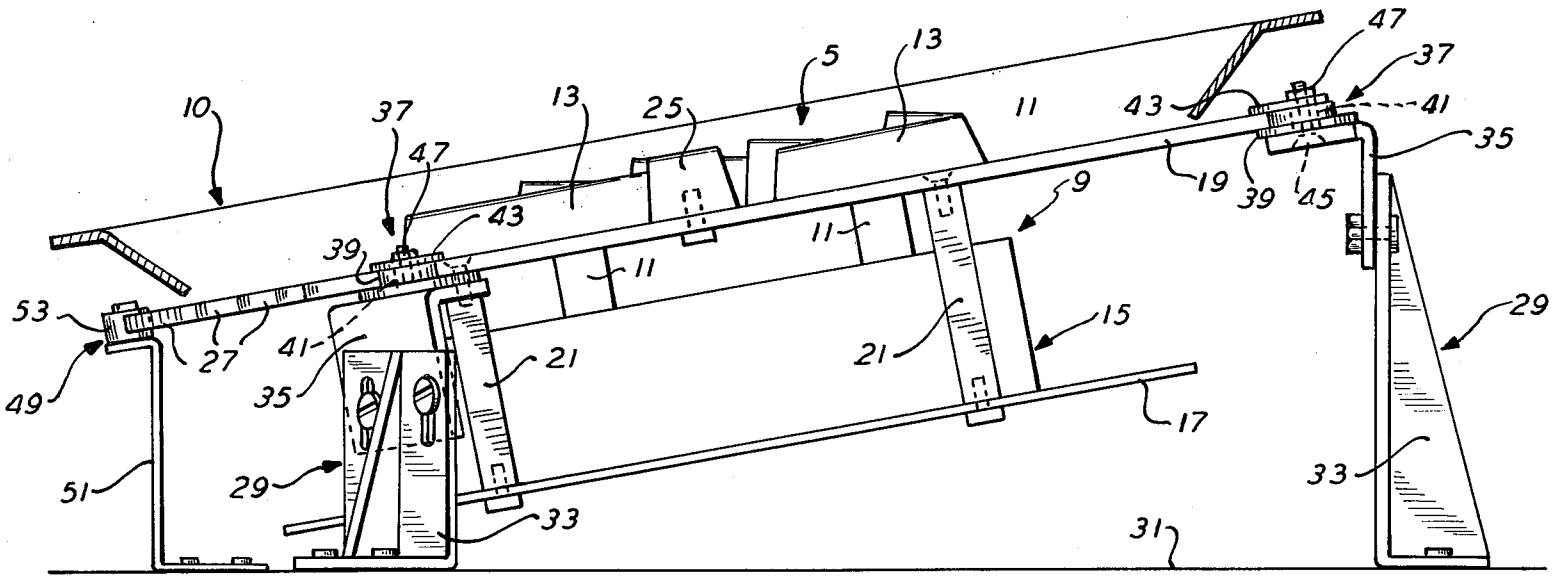
FIG. 3 is a simplified cross-sectional view of the rotatable keyboard utilized in the console unit of FIG. 1.
Figure 4:
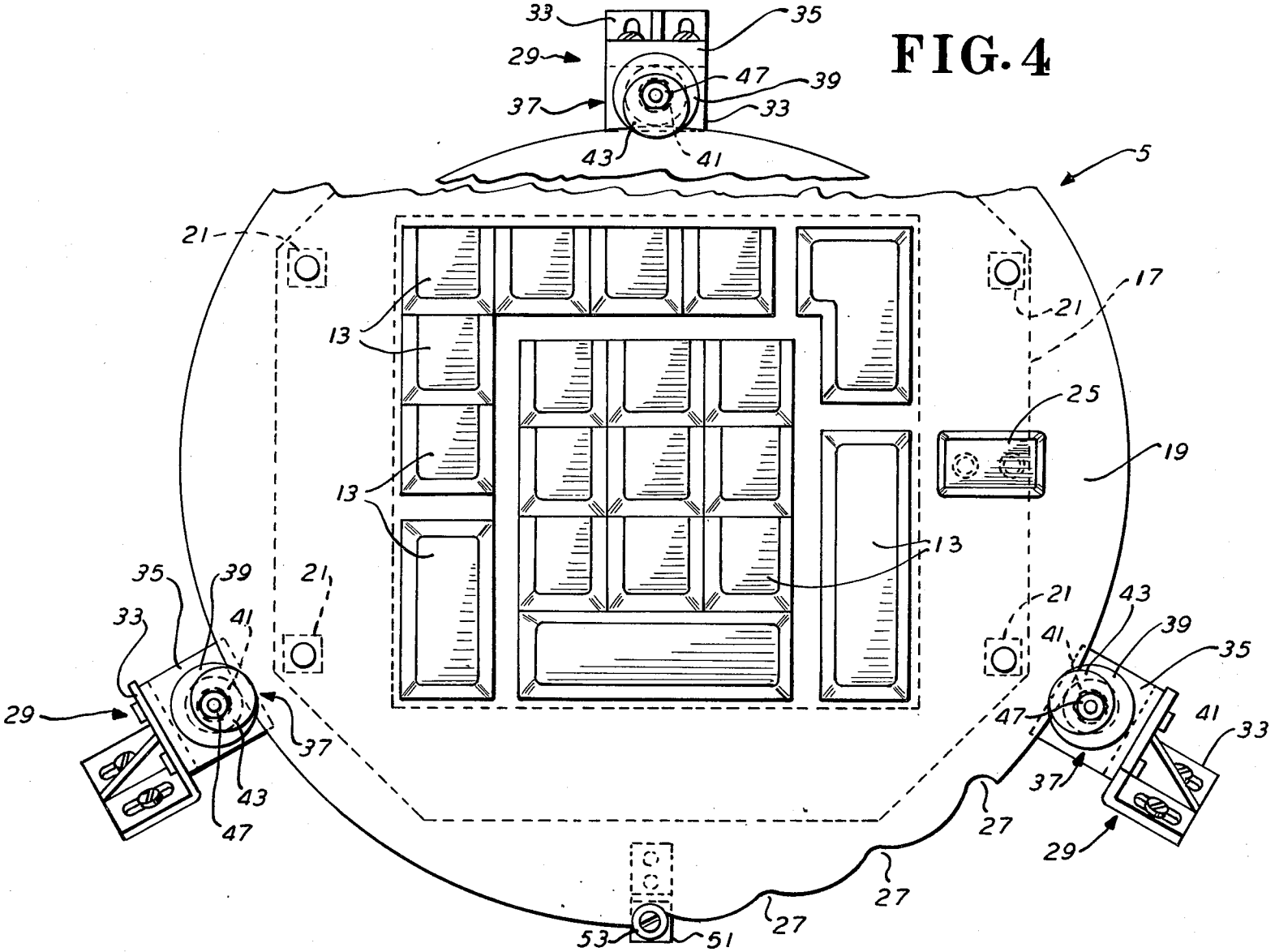
FIG. 4 is a top and cut-away view of the rotatable keyboard of FIG. 2.

Referring now to FIGS. 2–4 wherein the details of the rotatable keyboard 5 are illustrated. The keyboard 5 is mounted in an aperture 10 in the shelf 8 of the processing console unit 1 in a recessed fashion so that the top of the keyboard 5 is slightly below and parallel to the inclined surface of an inclined front section of the shelf 8. A conventional ten-key numeric and control keyboard unit 9 is utilized to connect individual key tops 13 to a conventional selector unit 15. The bottom of the square shaped selector unit 15 is fixed to the top surface of a larger, generally square shaped thin plate 17. This plate 17 is attached to a circular thin keyboard mask panel 19 by four equally spaced apart studs 21 which are fastened at their ends by screws to the top side of plate 17 and the under side of mask panel 19, near their edges. The keyboard mask panel 19 has a plurality of rectangular and L-shaped apertures 23 arranged so that the key tops 13 of the keyboard unit 9 fit snugly through them. A finger knob 25 is attached to the top side of mask panel 19 so that a seated operator can rotate said keyboard 5. This mask panel 19 also has four grooves 27 located next to each other cut into the edge of the panel 19 for positioning purposes. The panel 19 is rotatably mounted in aperture 10 by supporting assemblies, three vertical, bracket assemblies 29, spaced 120 degrees apart from each other, fastened at their bottom portions to a horizontally oriented base pan 31 attached to the front vertical edge of the shelf 8. Each bracket assembly 29 comprises a bottom stiffened bracket 33 and an upper angle bracket 35 fastened at one end to the upper portion of said stiffened bracket 33. In order to position the keyboard mask panel 19 at an angle the stiffened brackets 33 have different lengths and have two slotted apertures at each of their upper ends to accommodate two screws used to attach and properly orient the angle brackets 35 so that their upper sections are parallel to the mask panel 19. The keyboard mask panel 19 is rotatably supported by support assemblies 37. Each of these assemblies 37 comprise a grooved roller 39, preferably made of DELRIN material or other suitable material, a spacer 41, eccentric 43 and a screw 45 and a nut 47. The screw 45 goes through a hole in the center of the upper section of angle bracket 35 and fits through the openings of spacer 41, which fits within roller 39 and eccentric 43 and fastened on top of each other by nut 47. The eccentric 43 is positioned so that most of it overlaps the top edge of the mask panel 19 so as to form a U-shaped groove with roller 39 so that the panel 19 can easily be rotated therethrough. A spring assembly 49 fixed at its bottom portion to the top of the front section of the base pan 31 provides the necessary pressure to keep the mask panel 19 properly positioned against the three rollers 39 and to maintain the mask panel 19 in any of the several positions chosen by the operator. The spring assembly 49 comprises a vertically oriented Z-shaped spring 51 fixed at its lower end to the base pan 31 and has an upper portion which is inclined parallel to the mask panel 19. Rotatably mounted by a shouldered screw through a hole in said upper portion of said spring 51 is a roller detent 53. This roller detent 53 catches in the grooves 27 of the panel mask 19 to provide two detented rotation positions as well as stops for each end of the rotation swing.

In operation a seated operator grasps the finger knob 25 and rotates the keyboard 5 into the desired operating position. In doing so portions of the edges of the keyboard mask panel 19 slides within the U-shaped grooves formed by rollers 39 and eccentrics 43 into such desired detented position.

Obviously many modifications and variations of the present invention are possible in light of the above teachings. It is therefore, to be understood that within the scope of the appended claims the invention may be practiced otherwise than as specifically described.

What is claimed is:

1. A keyboard for a data processing unit comprising:

a rotatable circular keyboard mask panel, and a keyboard unit, attached to said keyboard mask panel.

2. The keyboard according to claim 1 wherein said rotatable circular keyboard mask panel rotates substantially in a horizontal plane.

3. The keyboard according to claim 1 further comprising:

rotatable supporting means, for supporting said keyboard mask panel thereon and for allowing said mask panel to slide thereon.

4. The keyboard according to claim 3 wherein said rotatable supporting means includes:

rotatably mounted grooved rollers means, a portion of which supports said mask panel.

5. The keyboard according to claim 4, wherein said rotatable supporting means includes:

an eccentric means, connected to the grooved portion of said roller means and overlapping said groove.

6. The keyboard according to claim 3 wherein said rotatable supporting means includes:

a plurality of equally spaces bracket assembly means.

7. The keyboard according to claim 6 wherein each of said bracket assembly means includes:

an upper angle bracket, and a lower angle bracket having slotted openings in its upper ends, and securing means, coupled through said slots, for attaching said lower end of said upper angle bracket to the upper end of said lower angle bracket.

8. The keyboard according to claim 5, wherein said grooved roller means engaging portions have a low coefficient of friction.

* * * * *